US005445003A

United States Patent [19]

Gottschalk et al.

[11] Patent Number: 5,445,003

[45] Date of Patent: Aug. 29, 1995

[54] ENGINE CRANK PIN ROLLING EQUIPMENT, ROLLING TOOL AND METHOD OF ROLLING ADJACENT AND OFFSET CRANK PINS

[75] Inventors: William P. Gottschalk, Davisburg; Hans T. Lauten, Commerce Township, both of Mich.

[73] Assignee: Hegenscheidt Corporation, Troy, Mich.

[21] Appl. No.: 176,792

[22] Filed: Jan. 3, 1994

[51] Int. Cl.[6] ..... B21K 1/08

[52] U.S. Cl. ..... 72/110; 72/107

[58] Field of Search ..... 72/107, 110

[56] References Cited

U.S. PATENT DOCUMENTS

| | | | |
|---|---|---|---|
| 4,485,537 | 12/1984 | Berstein et al. | 29/6 |
| 4,554,811 | 11/1985 | Hayashi et al. | 72/110 |
| 4,559,798 | 12/1985 | Hayashi et al. | 72/81 |
| 4,766,753 | 8/1988 | Berstein et al. | 72/110 |
| 5,138,859 | 8/1992 | Winkens | 72/110 |
| 5,235,838 | 8/1993 | Berstein | 148/510 |

*Primary Examiner*—Lowell A. Larson

*Attorney, Agent, or Firm*—Reising, Ethington, Barnard & Perry

[57] ABSTRACT

Arcuately offset pairs of juxtapositioned pin journals of an internal combustion engine crankshaft have their fillets pressure rolled for fatigue strengthening by opposing inclined rollers carried in cages at the lower ends of a pair of relatively rotatable tool housings supported in a side-by-side relationship by a pair of jaws of floating clamping structure. This structure allows the rollers to follow the crank pin journals as the crankshaft is being turned so that arcuately offset crank pin fillets can be simultaneously pressure worked and strengthened. Opposing roller reaction loads are cancelled at load receiving bearings operatively interposed between the pair of tool housings.

11 Claims, 7 Drawing Sheets

222
224
226
230
228
98
88
90
74
230
95
124
80
80'
134
190
76
78'
60
136
78
55
104
54
82
100
B
96
108
112
98
93
64
95
120
122
126
200
94
97
118
92
62
110
116
114
70
106
66
102
72

222
P
228
226
233
234
232
125
4C
121
88
100
62
110
60
230
133
95
68
80
90
131
192
4C
82
A
134
58
93
84
136
190
208
96
116
200
94
205
132
110
56
204
210
116
120
92
70
66
102
55
58
56
54

ENGINE CRANK PIN ROLLING EQUIPMENT, ROLLING TOOL AND METHOD OF ROLLING ADJACENT AND OFFSET CRANK PINS

BACKGROUND OF THE INVENTION

This invention relates to deep rolling of fillets of engine crankshafts or other annular areas of metallic work pieces subject to operating high stress loads, and more particularly, to a new and improved machine, rolling tool and method to simultaneously deep roll the fillets of arcuately offset, juxtapositioned crank pin journals to increase their fatigue strength and surface layer hardness.

DESCRIPTION OF RELATED ART

In internal combustion engines such as V-6 engines found in many modern automobiles the left bank of cylinders of the engine block is set slightly forward of the right bank. This cylinder arrangement allows the connecting rods of paired pistons mounted in the cylinders in opposite banks of the engine to be connected side-by-side to adjacent or juxtapositioned journal portions of a common crank pin. To provide for even firing, in which the cylinders fire at 120 degree intervals, the centerline of each such journal portion radiating from the axis of rotation of the crankshaft are arcuately spaced from one another by an included angle of 30 degrees, for example. Other V-block engines with different cylinder arrangements, "V-10" for example, may have a different crank pin journal offset.

Because of crankshaft design and such crank pin journal offset, the crankshaft may be operationally stressed at the crank pin journal fillet areas to such an extent that fillet cracking and crankshaft bending may occur during engine operation to materially decrease crankshaft service life. To improve durability, the crankshaft may be strengthened by increasing crank pin journal diameter and by heat-treating (quenched and tempered) the crankshaft to increase yield and fatigue strength. Fatigue strength and durability of crank pins and main bearing journals can importantly be increased by deep rolling compressive stresses into the metal of the annular fillets between the pin journals and adjacent counterweights or bearing collars.

Furthermore, with downsizing of automotive vehicles and their components for reducing weight and improving fuel efficiency, smaller engines and crankshafts are needed. To improve fatigue strength and durability of downsized crankshafts, deep rolling of fillets and other circular joint areas is increasingly important with fatigue strength improvements ranging from 20%–150%.

Before the present invention, such fillet rolling of arcuately offset journals of crank pins was difficult and time consuming particularly since the fillets of side-by-side and arcuately offset crank pin journals had to be independently rolled with high-load fillet rolling machines in a time consuming and tedious operation. The side loads resulting from independent rolling could cause the rolling tool to "self center" and move off of the fillet so that desired compressive fillet stresses and fatigue strength were reduced or not obtained.

Examples of equipment, tooling and procedures generally related to the present invention can be found in prior art patents such as U.S. Pat. Nos.: 5,138,859 issued Aug. 18, 1992 for "Method and Apparatus For Smooth Rolling and Deep Rolling Multi-Stroke Crankshafts"; 4,785,537 issued Dec. 4, 1984 for "Machine For the Machining of Crankshafts"; and 4,766,753 issued Aug. 30, 1988 for "Rolling Apparatus For Surface Hardening or Smoothing" all assigned to Wilheim Hegenscheidt GmbH, Bernhard-Schondorfp Platz, D-5140 Erkenlenz, Germany and hereby incorporated by reference.

In contrast to the above identified prior art patent disclosures, the present invention is drawn to new and improved fillet rolling methods, tooling and machinery for the tooling that provides for the new and improved simultaneous deep rolling and fatigue strengthening of the fillets of contiguous arcuately offset crank pin journals and other annuluses.

The upper tooling of this invention comprises side-by-side main housings in which back up rollers are mounted. Secured to the lower or work end of each housing is a cage which carries an angulated or inclined work roller that has rolling contact with a peripheral surface of the back up roller so that loads applied to the housings will be transmitted by the back up roller to the inclined metal working roller and then to the grain structure of metallic fillets of crankshaft pins being deep rolled for fatigue strengthening.

The crankshaft whose pin fillets are being rolled is mounted in a chuck or other work piece holder and driven about its rotational axis by a motor drivingly connected to the chuck so that the work rollers pressure roll the annular fillets of the crank pins.

A caged annular thrust bearing unit operatively mounted between the tool housings maintains their orientation in parallel planes while they are being relatively rotated and turned about the axis of an engine crankshaft. This thrust bearing unit importantly provides structure to accommodate and neutralize the opposing resulting lateral thrust loads generated by the opposing and outwardly inclined rollers during deep rolling operation. With opposing lateral thrust loads being cancelled, the tooling remains on center even though the journal portions of each pin are arcuately offset from one another.

In addition to the upper tooling, a pair of lower support tools is provided, each having two back up rollers that support the pin journals as the work rollers of the upper tooling deep roll the fillets of the crank pins. These back up rollers are strategically located beneath the pin journals to receive rolling loads transmitted through the pin journals so that no appreciable bending loads will be applied to the crankshaft when being rolled.

The upper and lower pairs of tools are respectively supported in parts of upper and lower jaws of "floating" clamping structures, each comprising a pair of levers which are pivotally connected together by an intermediate pivot. Hydraulic power cylinders interconnecting end portions of the clamping levers are operable to generate the working force transmitted through the jaws for the fillet rollers by the powered expansion of the cylinders. To provide for the individual operation of each pair of jaws, the clamping structure is pivotally mounted for "floating operation" by supporting swing arms that swing back and forth or oscillate pendulum fashion during deep rolling operation.

In this invention a new and improved method of fillet rolling of a metallic component, such as a pin journal of a crankshaft, is provided in which arcuately offset annular fillets of side-by-side pin journal portions are simultaneously deep rolled to compressively stress the metal of the fillets and thereby increase the fatigue strength of the component.

It is another feature, object and advantage of this invention to provide a new and improved metal rolling machine comprising pairs of pivotally connected levers with metal working rollers in tooling mounted in clamping jaws of the levers which float around axis of an internal combustion engine crankshaft for simultaneously deep rolling of pairs of offset annular fillets of offset pins of the crankshaft.

Another feature, object and advantage of this invention is to provide new and improved tooling for rolling annular and arcuately offset work areas such as crankshaft pin journal fillets featuring side-by-side relatively rotatable housings each having a fillet rolling device mounted thereto so that laterally spaced and arcuately offset fillets can be simultaneously deep rolled and metal worked to improve their fatigue strengths.

These and other features objects and advantages of this invention will become more apparent from the following detailed description and drawings in which:

DESCRIPTION OF THE DRAWINGS

Detailed Description

Figure 1:
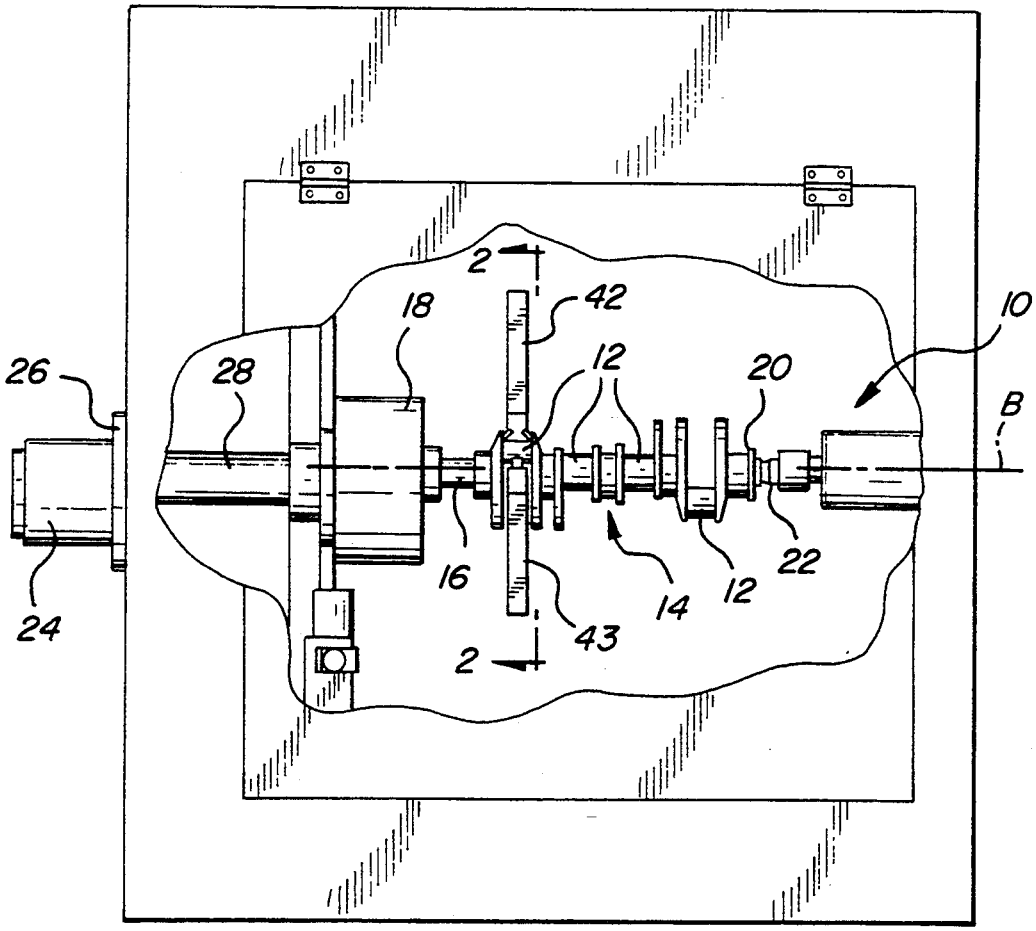
FIG. 1 is a schematic front view of a fillet rolling machine illustrating some basic principals of fillet rolling employed in the present invention.
Figure 2:
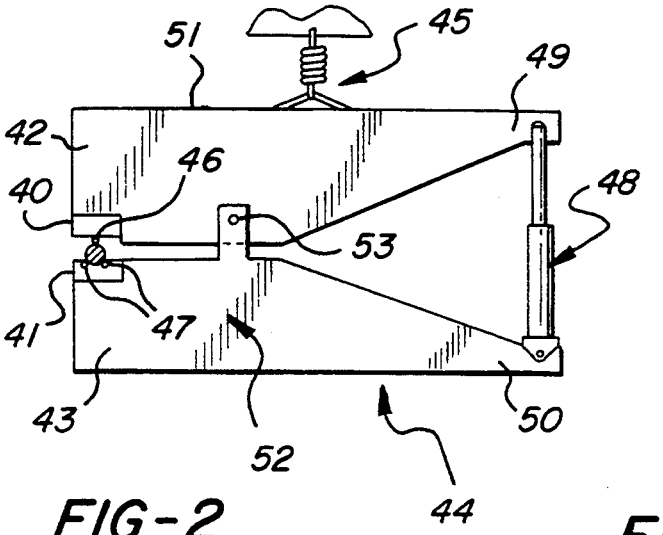
FIG. 2 is a schematic view of a portion of the machine of FIG. 1 taken generally along sight lines 2—2 of FIG. 1.
Figure 1A:
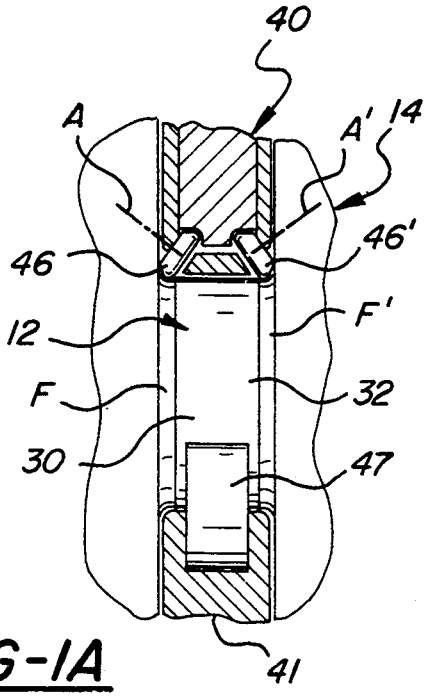
FIG. 1A is an enlarged view of a portion of FIG. 1 showing tooling rolling the fillets of a crank pin journal.
Figure 1B:
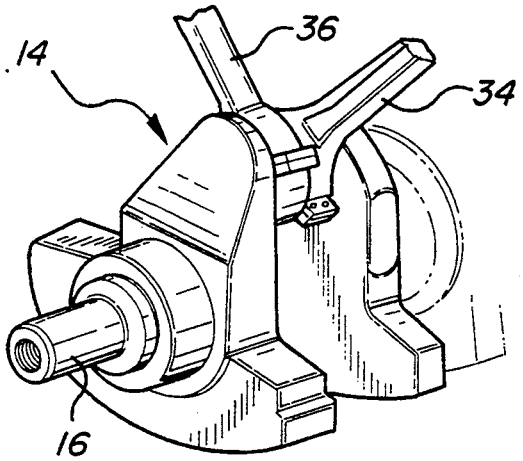
FIG. 1B is a pictorial view of a portion of a crankshaft with connecting rods mounted side-by-side on juxtapositioned pin journals.

Turning now in greater detail to the drawing, FIGS. 1 and 2 diagrammatically show portions of a metal working machine 10 illustrating some principals of deep roll strengthening of the fillets of crank pins 12 of a crankshaft 14 for an internal combustion engine. The crankshaft has a nose end 16 mounted in a chuck 18 and a flange end 20 supported by a dead point center 22 of the machine. The crankshaft can be selectively and rotatably driven about horizontal axis B by a drive motor 24 supported by a mounting collar 26 on the machine housing and drivingly connected to the chuck by drive shaft 28. Each of the crank pins 12 have side-by-side and coaxial journal portions 30 and 32 (FIG. 1A) providing cylindrical bearings for the connecting rods 34, 36 (FIG. 1B) of opposing pistons in the left and right cylinders of V-block engines.

In view of the fact that the pin journal portions 30, 32 experience high stress loads during engine operation, they are strengthened in various ways such as by increasing pin journal diameters and by deep roll hardening their laterally spaced annular fillets F, F′ in which high and concentrated rolling forces are directed to annular fillet areas of the crankshaft. Such rolling produces compressive strengthening stresses in the metal of the crankshaft fillets that may, for example, extend to a depth of 4 mm.

As illustrated in FIG. 2, this is accomplished in the machine 10 by upper and lower tools 40 and 41 operatively mounted in the facing jaws 42, 43 of a load applying jaw assembly 44 forming a part of the machine and supported for operation by flexible support 45.

The upper tool 40 has a pair of floating rollers 46, 46′ of hardened steel or other suitable material which generally turn on oppositely inclined axes "A and A′′′" to engage and roll the laterally spaced fillets F, F′ providing the annular joint areas between the pins and the adjacent counter weights or bearing collars of the crankshaft. The lower tool 41 has arcuately spaced back-up rollers 47 that provide the bearing and support for the crank pins as the crankshaft 14 is being rotatably driven about its axis B and the fillets are being rolled. Rolling pressure is hydraulically applied by the expansion force of a hydraulic cylinder 48 operatively connected between the extending ends 49, 50 of the upper and lower jaw arms 51, 52 pivoted together by a clevis mounted pivot 53 disposed at an intermediate position along the jaw arm lengths. This arrangement provides the mechanical advantage that amplifies the jaw closure force exerted to the jaw assembly by the expansion force of the hydraulic power cylinder 48.

In an automated machine and by virtue of the flexible support 45, the upper and lower jaws and their tools are supported to float around the axis of the orbiting crank pins during rolling. Rolling pressure exerted by the rollers 46, 46′ can be increased and decreased by cylinder 48 during rotational drive of the crankshaft by motor 24 to impart concentrated annular residual stress patterns in the metal of the fillets F, F′ which are among the most highly stressed cross-sectional areas of the crankshaft in engine operation. The amount of pressure as well as the number of over rolls of the fillets can be preselected to produce an optimized fatigue strength.

Such rolling procedures, tooling and machinery, satisfactory for many crankshaft designs, do not meet higher standards for improved strengthening and for higher volume production of crankshafts 54 having crank pins 55 with arcuately offset and contiguous crank pin journals 56, 58 (FIG. 4A) employed in many modern "V" block engines. To meet such higher standards, the present invention, exemplified in a first preferred embodiment in FIGS. 3 through 9, has been devised.

Figure 5:
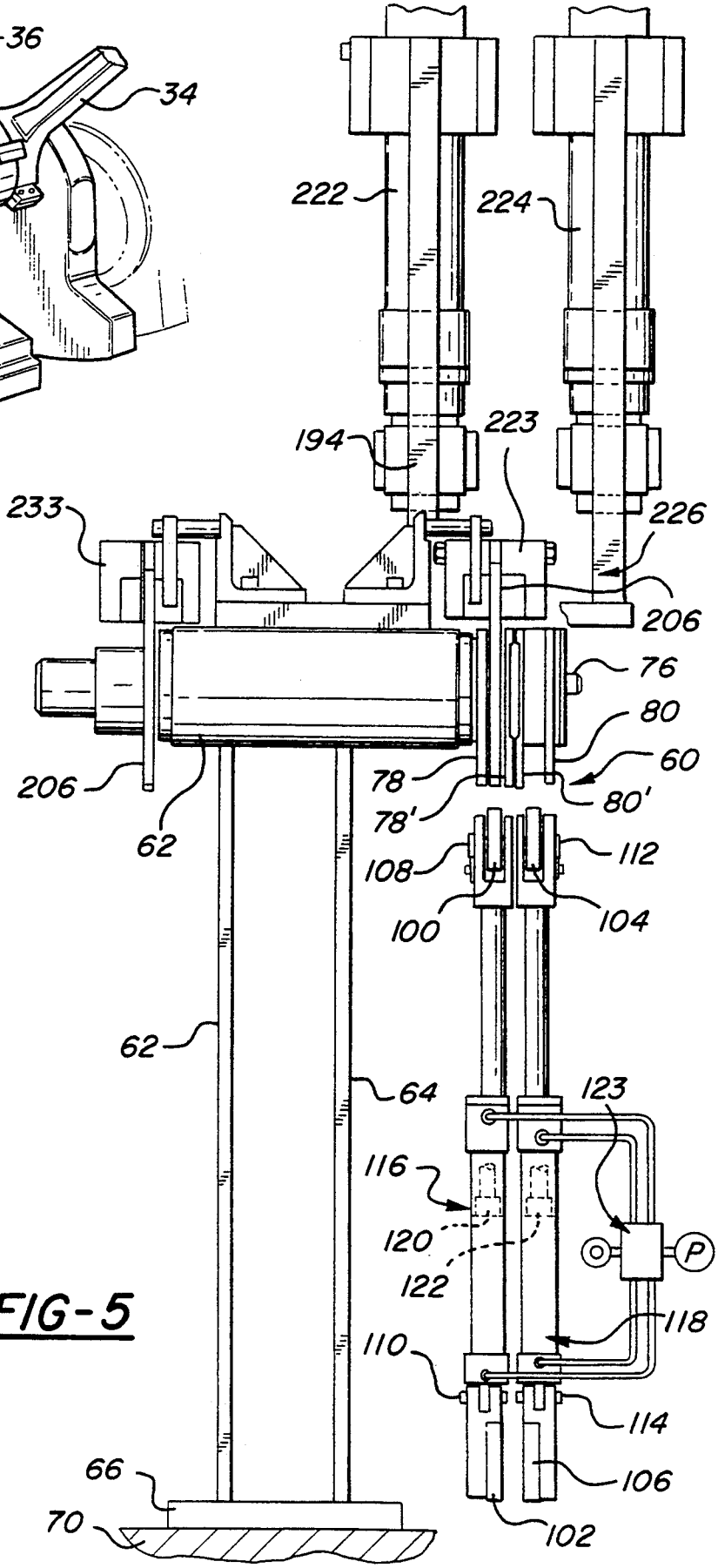
FIG. 5 is an end view with parts broken away of the fillet rolling machine of FIG. 4 as seen from view arrow A of FIG. 4.
Figure 3:
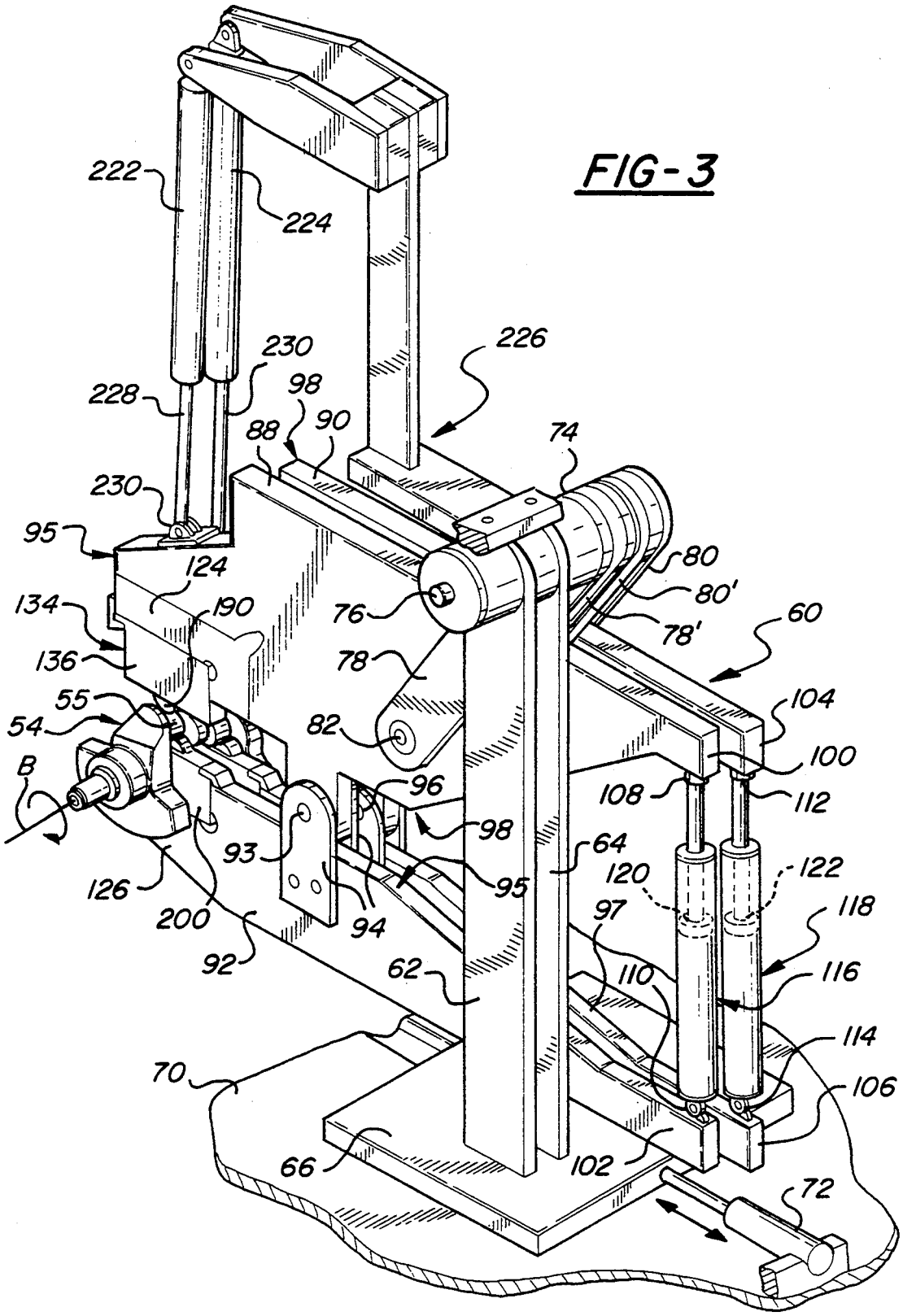
FIG. 3 is a pictorial view of one preferred embodiment of a fillet rolling machine according to this invention.
Figures 4, 4A:
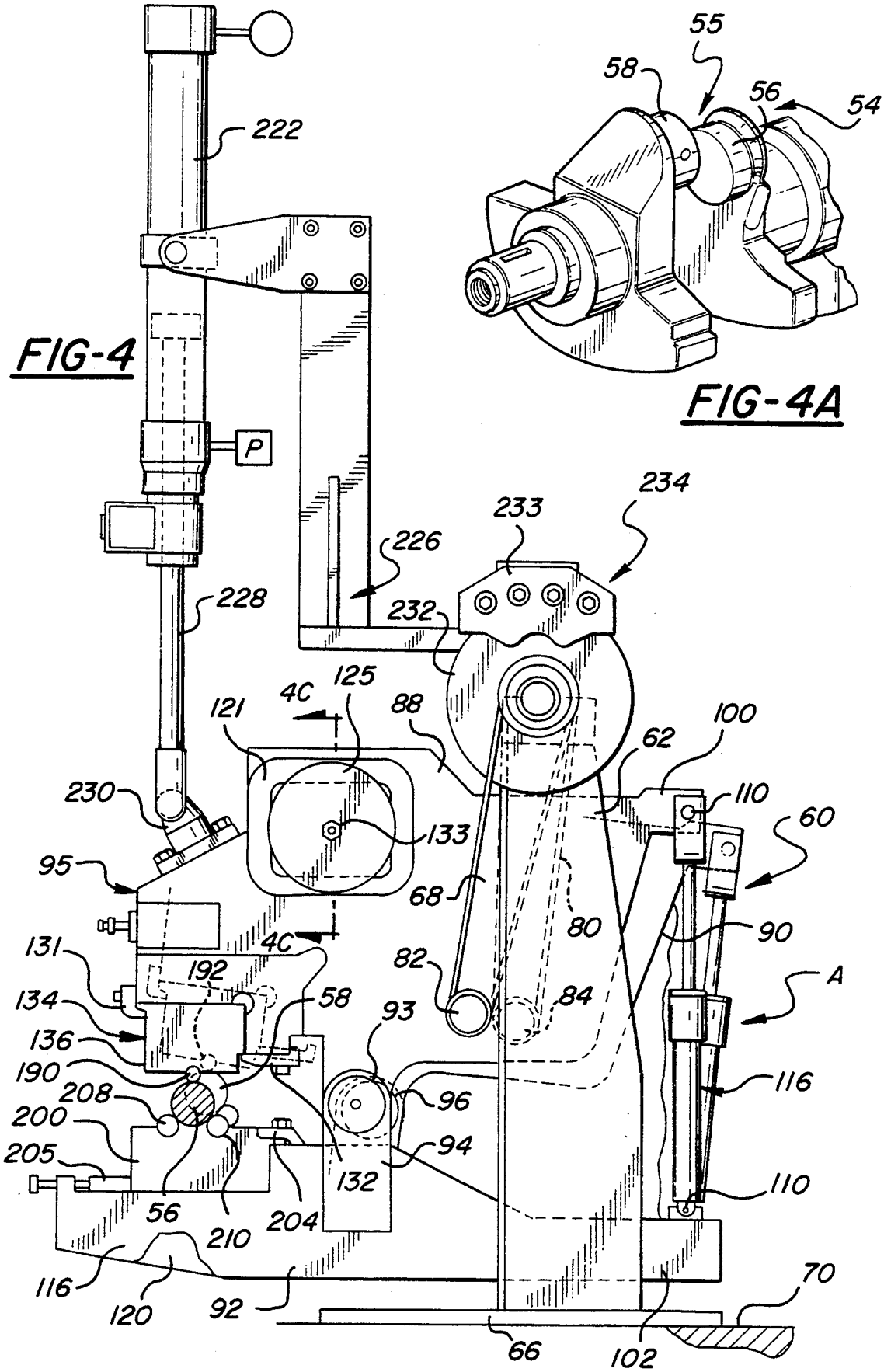
FIG. 4 is a side view of the fillet rolling machine of FIG. 3.
FIG. 4A is a pictorial view of a portion of a crankshaft for an internal combustion engine having arcuately offset and side-by-side crank pin journals.
Figure 4B:
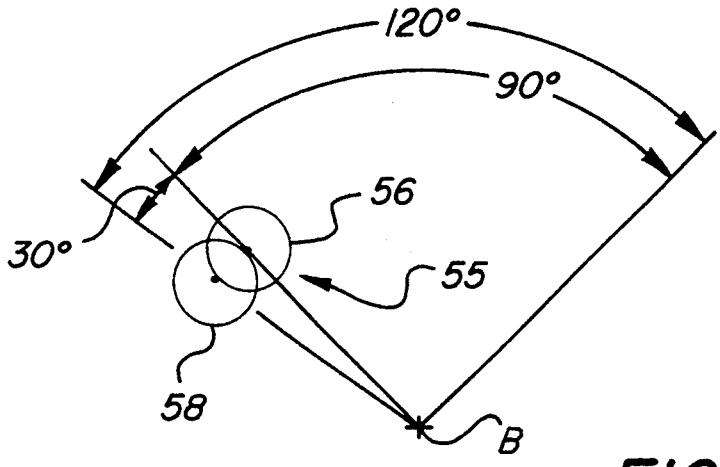
FIG. 4B is a diagram of the arcuately offset crank pin journals of FIG. 4A crankshaft.

As shown in the pictorial view of FIG. 3, the side view of FIG. 4 and the end view of FIG. 5, the machine 60 of this invention has a pair of side-by-side uprights 62 and 64 extending upwardly from a base 66 that is adjustably mounted by tongue and groove or other rail construction to a support plate 70. This rail construction and connected power cylinder 72 allows the machine and its tooling to be readily moved into and out of engagement with the arcuately offset pin journals 56,58 of the crankshaft 54 when loaded into a drive chuck and dead point center as in FIG. 1.

Supported at the top of the uprights 62 and 64 is an elongated transversely extending cylindrical support 74. A pivot shaft 76 extends axially through the cylindrical support 74 and has a terminal end which fixedly supports the ends of right and left hand pairs of swing arms 78, 78' and 80, 80', which depend therefrom. The terminal ends of the swing arms carry support pivots 82 and 84 that respectively pivotally connect to the upper right and left hand jaw arms 88 and 90 that respectively extend between their associated pairs of swing arms. The upper right hand jaw arm 88 is pivotally connected to a lower right hand jaw arm 92 by an intermediate horizontally extending pivot 93. This pivot is supported by clevis 94 whose ears extend upwardly from the lower jaw arm to bracket the upper jaw arm. This construction provides a right hand clamping jaw set or assembly 95. The upper left hand jaw arm 90 is similarly connected by a clevis and pivot pin 96 to a lower left hand jaw arm 97 to provide a left hand jaw set or assembly 98. The right and left jaw arm clevises respectively receive downwardly extending lower portions of the upper jaw arms therebetween so that the upper and lower jaw arms of each pair are co-planar when pivotally connected by pivots 93 and 96 respectively.

The upper and lower jaw arms of each jaw assembly are made from flat metal plate stock and have rearwardly extending portions 100, 102 and 104,106 that provide connection points for the clevises and pivot pins 108, 110, 112, 114 for right and left hydraulic power cylinders 116, 118. Each power cylinder has a cylinder tube in which a piston 120 or 122 is operatively mounted. Controls 123 controls the supply and exhaust of pressure fluid to the cylinders below and above the pistons to effect the expansion and contraction strokes of the cylinders so that the forwardly extending jaws 124, 126 and 128, 130 of the right and left hand pairs of jaw arms respectively close or open. For example, by supplying pressure fluid to the pressure chambers above the pistons and exhausting fluid from the chambers beneath the pistons, the cylinders and pistons contract to turn the jaw arms on pivots 93 and 96 so that the jaws move to an open position apart from one another. This enables the tooling to be moved into working position with the crank pin journals 56, 58 or the crank removed from the tooling.

Figure 4C:
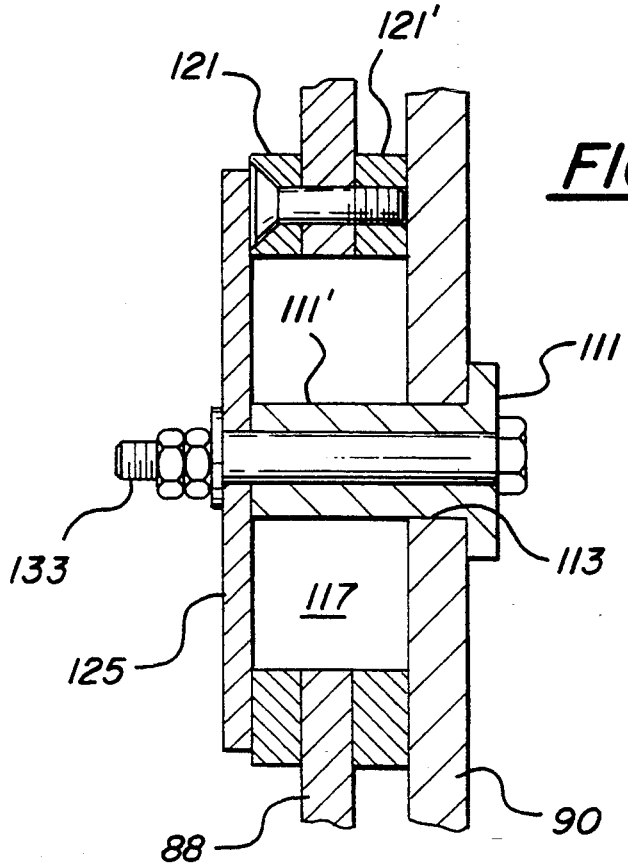
FIG. 4C is a cross-sectional view taken along sight lines 4c—4c of FIG. 4.

FIG. 4C illustrates a spacing arrangement to maintain the relatively movable upper jaw arms 88, 90 in a parallel and laterally spaced relationship with respect to one another. This arrangement includes a cylindrically headed spacer element 111 having a cylindrical shank 111' extending axially through a corresponding close fit opening 113 in upper left hand arm 90 and through a large dimensioned opening 117 in the right hand upper arm 88. Secured by threaded fasteners to the upper arm 88 around the opening are inboard and outboard brass wear rings 121, 121'.

An enlarged annular washer 125 secured to the outboard end of the retainer shank by a through bolt 133 has siding contact with the outer brass ring.

Figure 7:
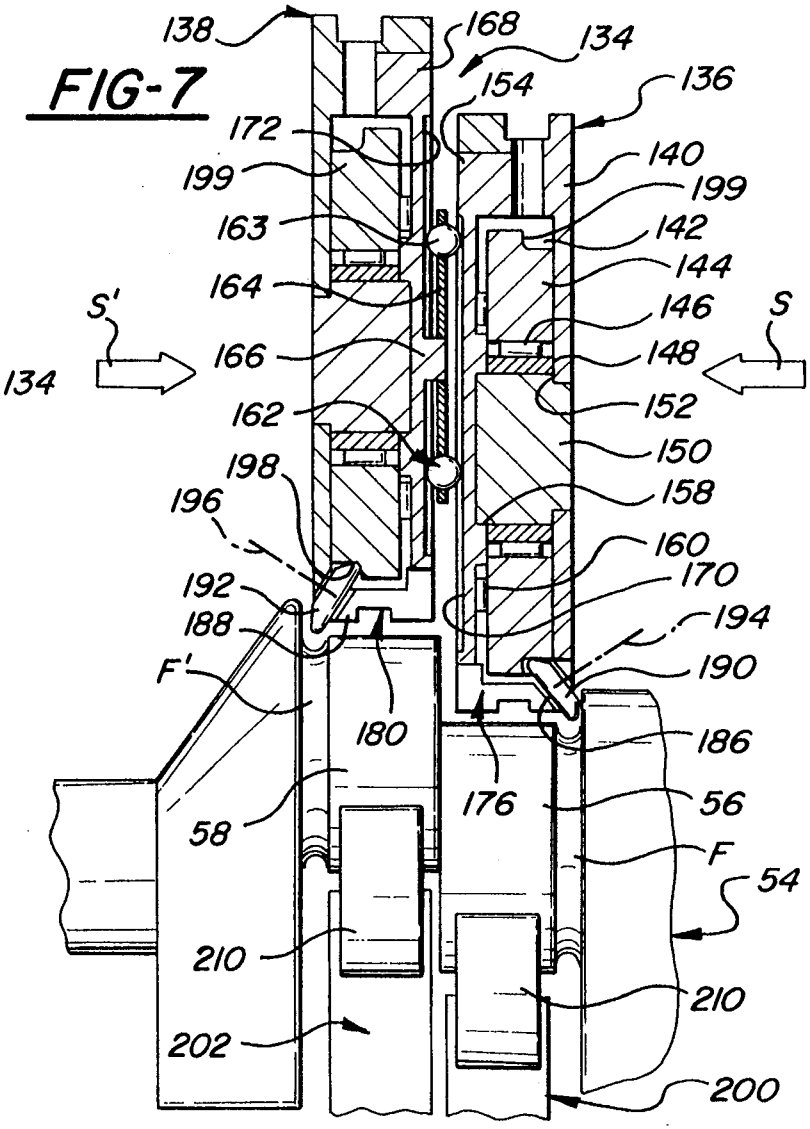
FIG. 7 is a sectional view of the tooling of FIG. 5 taken along sight lines 7—7 of FIG. 6 but with a portion of the engine crank and back-up lower tooling added.
Figure 6:
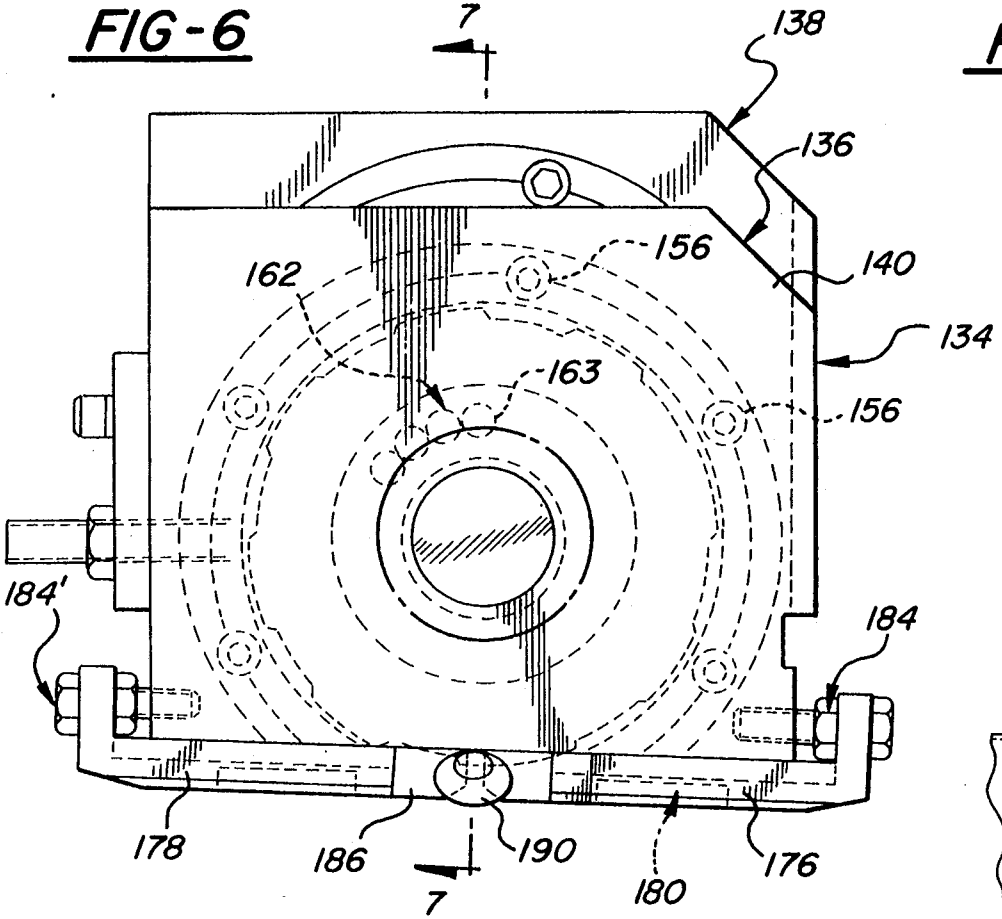
FIG. 6 is an enlarged side elevational view of tooling used in the fillet rolling machine of FIGS. 3, 4 and 5.
Figure 8A:
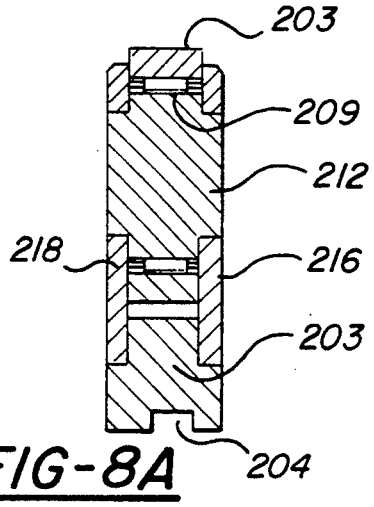
FIG. 8A and 8B are cross-sectional views of the lower support tooling respectively taken along sight lines 8A—8A and 8B—8B of FIG. 8.
Figure 8B:
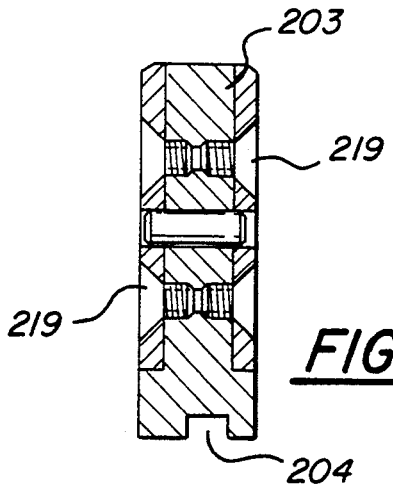
Figure 8:
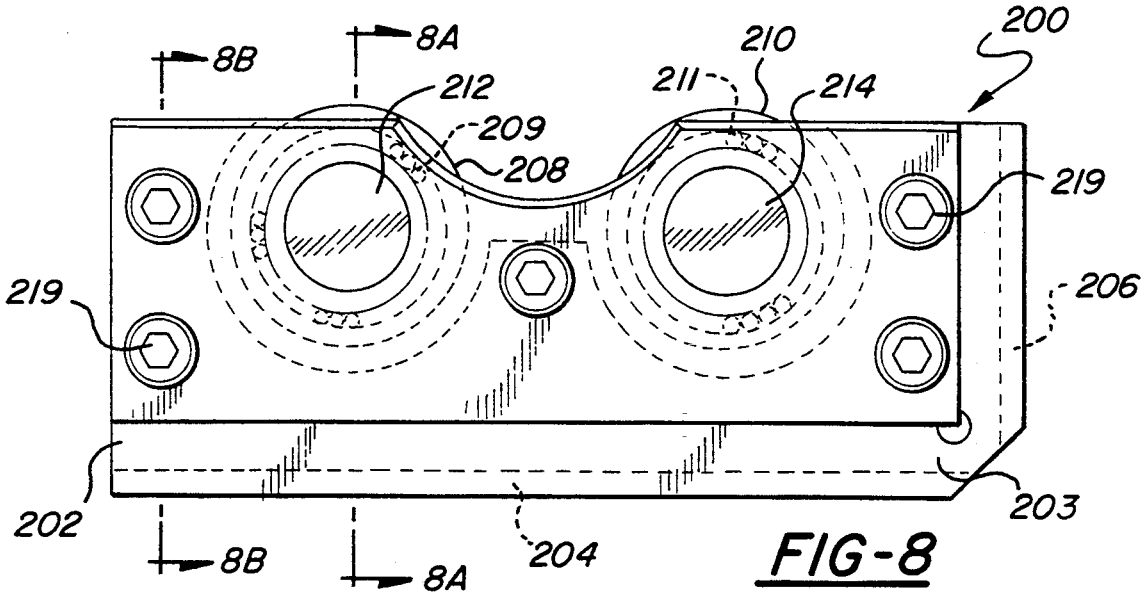
FIG. 8 is a side elevational view of lower support tooling used for the fillet rolling machine of FIG. 4.
Figure 9:
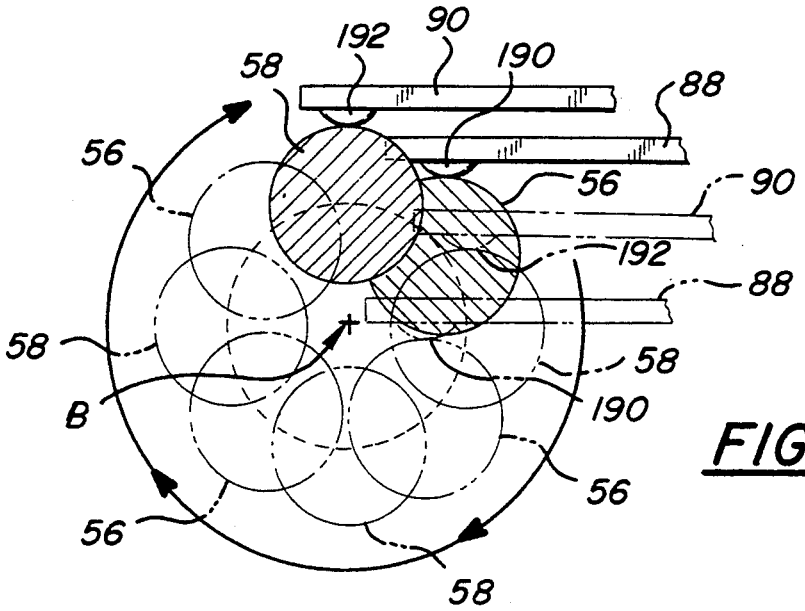
FIG. 9 is a diagram illustrating the rolling of arcuately offset pin fillets according to this invention.

The upper jaw 124, 128 of each upper jaw arm 88, 90 provides a seat for a pin fillet rolling tool assembly 134 shown best in FIGS. 6 and 7. The fillet rolling tool assembly 134 comprises a pair of tool housings 136 and 138 mounted in a side-by-side and relatively rotatable relationship with respect to one another. Retention clamps such as 131 and 132 secure the housings to the respective upper jaws 124 and 126.

Each of the housings is substantially the same so that only housing 136 is described in particular detail. The housing 136 comprises an outboard rectangular main body 140 that has been milled or otherwise formed to provide an annular recess 142 that receives a back up roller 144 rotatably mounted therein by needle bearings 146 fitted on an inner cylindrical race 148, race 148 is supported on a large axially extending diameter hub 150 shouldered at 152 to fit into an annular opening in the outboard side of the main body 140. The housing 136 is closed at its inboard side by a annular cover plate 154 which is secured to the housing by threaded fasteners 156. The cover plate 154 has an enlarged annular recess 158 to receive the inboard end of the cylindrical hub 150.

An annular cage of needle thrust bearings 160 supported on an internal shoulder of the cover plate concentric with the hub journal 150 is disposed between the back up roller and the cover plate and is adapted to transmit side loads resulting from the rolling of the fillets to an annular ball bearing unit 162 operatively disposed between the tool housings 136 and 138. The spherical balls 163 of this ball bearing unit are supported for rotation in cages in a support plate 164 operatively mounted on a centralized hub 166 extending axially from the cover plate 168 of adjacent tool housing 138. During operation by the powered rotation of the crankshaft, the spherical balls 163 roll in annular dished out bearing surfaces 170, 172 in the interfacing cover plates 154 and 168.

Each housing 136, 138 has a pair of L-shaped work roller retainers 176, 178 and 180, 182 adjustably secured to the lower end thereof by threaded fasteners 184,184'. These retainers have inboard ends which are recessed to provide cages 186, 188. When the retainers are secured to their housings the cages support the hardened working rollers 190, 192 for floating rotation generally about upwardly and outwardly inclined axes 194, 196 so that the working circumference of the rollers extend to the fillets F and F' of the crank pin journals 56,58 being rolled. The work rollers 190, 192 are contacted by the annular stepped shoulders 197, 198 of backup rollers 144, 199 of housings 136, 138 respectively so that jaws when clamped will transmit a rolling force to the fillets F, F' as shown in FIG. 7.

With the bearing unit 162 interposed between the two housings 136, 138, opposing side loads S, S' resulting from fillet rolling operation are effectively neutralized. This ensures that each of the fillets will be deep rolled in accordance with specifications and the tooling does not move from the fillets.

The steady rest tooling secured to the lower jaw of each jaw assembly is provided by first and second steady rest units 200 and 202 which are respectively operatively mounted to the lower jaws such as by adjustable clamps 204,206 of each lower jaw arm. Since these units have substantially the same construction only unit 200 is described in particularly detail. Unit 200 has a generally rectilinear main body 203 with peripheral grooves 204, 206 which receive the edges of the plate of the lower jaw arm 92. Clamps 205 and 207 secure the unit 200 in position on the lower arm.

Tool 200 has a pair of spaced rollers 208 and 210 which are rotatably mounted by needle bearings 209, 211 on hubs 212,214 supported by laterally spaced side plates 216, 218. Threaded fasteners 219 secure the side plates to the main body 203.

To stabilize the pairs of jaw arms, pneumatic cylinders 222, 224 secured by bracket 226 to the cylindrical support 74 are employed. The cylinders 222, 224 respectively have pistons with rods 228, 230 extending downwardly which are pivotally connected to the upper jaw arms by bracket 230, 231 to control operation of the jaws and to stabilize the jaw arms when the fillets are being rolled.

Element 232 is a rotor fixed to rotatable shaft 76 which cooperating with caliper 233 provides a disc brake 234 that can be selectively applied to hold the pairs of jaws in any selected position.

For the fillet rolling of the offset pin journal, the crankshaft 54 is placed into the chuck and center pin, as shown in FIG. 1. Then the tooling of FIGS. 3 through 8 is moved into position so that the working rollers contact the fillets F, F′ of the offset pin journals 56, 58 as shown in FIG. 7. The jaws are closed under load by the expanding cylinders so that the work rollers 190, 192 engage the fillets F, F′ with a selected rolling force.

The drive motor 24 is then energized so that the chuck will rotatably drive the crankshaft about its rotational axis such as axis B. This rotation causes the offset pin journals 56, 58 to move in a circular path or orbit clockwise about the axis B of the crankshaft as the shaft is being turned (see FIG. 9). The clamping jaws, being clamped to the offset pins, follow the rotational path of the pins. Accordingly, when the pins rotate around the axis B of the crankshaft, each jaw assembly will float and the support arms 78, 78′, 80, 80′ swing backwards and forward as a pendulum allowing this movement.

The rolling pressure of the jaws translated to the working rollers can be increased or otherwise varied to effect the simultaneous deep rolling of the fillets and the deep metal working of the fillet areas to effect the improved fatigue strength of fillets and of the crankshaft. Since the crank pins are offset from one another, each set of arms follows its associated crank pin so that the fillets of the crank pin are simultaneously rolled even though they are arcuately offset. During rolling, suitable lubricants are applied to the fillet areas to reduce friction and enhance rolling.

After fillet rolling is completed, the power cylinders can be contracted to open the jaws so that the finished crankshaft can be removed from the machine.

While only one pair of rolling jaws, comprising a fillet rolling assembly has been shown and described, it will be appreciated that for the six cylinder engine there would be three pairs of offset crank pins for an even firing engine and three assemblies or pairs of jaw mechanisms for fillet rolling the pins of a crankshaft in a machine constructed along the lines as disclosed in the figures.

While a preferred embodiment of the invention has been shown and described, other embodiments will now become apparent to those skilled in the art. Accordingly, this invention is not to be limited to that which is shown and described but by the following claims.

What is claimed is:

1. A rolling tool for simultaneously and compressively rolling facing annular fillets of contiguous pin journals of a metallic crankshaft arcuately offset from one another comprising first and second housings, each of said housings having a cage at the lower end thereof, a hardened fillet work roller operatively mounted in each of said cages and operatively inclined outward to physically engage an associated one of said fillets so that both of said facing fillets can be simultaneously rolled by said work rollers, bearing structure directly and operatively mounted between said housings allowing said housings to move in substantially parallel planes relative to one another and for receiving opposing side loads resulting from the simultaneous rolling of said facing fillets of said contiguous and arcuately offset pin journals.

2. The rolling tool of claim 1 wherein said bearing structure includes a support between said housing and discrete bearings mounted thereon which directly contact each of said housings and receive opposing lateral loads resulting from the compressive and simultaneous rolling of said facing fillets of said pin journals.

3. A machine for fatigue strengthening a metallic crankshaft for an internal combustion engine by simultaneously mechanically rolling and working the substrate of the adjacent and facing fillets of pairs of contiguous cylindrical crank pin bearings having parallel central axes offset from one another and parallel to the rotational axis of said crankshaft comprising a support, a plurality of swing arms pivotally connected to said support, first and second clamping jaw sets, each said jaw set having a lower jaw and an upper jaw and a pivot for pivotally connecting said lower jaw and said upper jaw to one another, an additional pivot for connecting each of said jaw sets to said swing arms associated therewith, each of said jaw sets having a pair of jaws defining tool holding means, and first and second fillet rolling tool housings operatively and respectively mounted in the jaws of said first and second jaw sets, and at least one fillet work roller supported in each of said housings for rolling said adjacent and facing fillets and working the substrate thereof in response to the rotation of said crank about said axis of rotation causing each of said swing arms supporting said associated jaw set to swing and oscillate in an arc while said fillets are being rolled by said work roller tools and bearing structure directly interposed between and contacting said first and second fillet rolling tool housing to receive opposing side loads generated during rolling of said adjacent and facing fillets.

4. A machine for fatigue strengthening a metallic crankshaft for an internal combustion engine by simultaneously mechanically working the substrate of the adjacent and facing fillets of cylindrical and contiguous crank pin bearings directly connected to one another and having central axes arcuately offset from one another which are parallel to the rotational axis of said crankshaft comprising support means, swing arm means, pivot means operatively connecting said swing arm means to said support means, first and second clamping jaw sets, each jaw set having a lower jaw and an upper jaw and pivot means for pivotally connecting said lower jaw and said upper jaw to one another, additional pivot means for connecting said each said jaw sets to said swing arm means associated therewith, each of said jaw sets having a pair of jaws defining tool holding means, first and second housings carried respectively the jaws of said first and second jaw sets, a work roller carried by each of said housings so that said fillets can be simultaneously rolled and the substrate thereof worked in response to the rotation of said crank about said axis of rotation, and bearing means disposed directly between said first and second housings to receive opposing lateral side loads generated in response to the rolling of said adjacent and facing fillets.

5. A machine for simultaneously working the facing fillets of axially spaced, arcuately-offset and contiguous cylindrical journals of an elongated metallic workpiece having a centralized axis comprising:

a floating tool holder assembly formed from first and second pairs of laterally spaced upper and lower lever arms, each of said lever arms having discrete forward and terminal end portions, pivot means pivotally connecting an upper lever arm to a lower lever arm of each pair of lever arms between the forward and terminal end portions thereof, said upper and lower lever arms of each pair of pivotally connected arms having force receiving end near the terminal end portions thereof and force apply jaws at the forward ends thereof, force generating means operatively connected to said terminal end portions of each of said pairs of pivotally connected lever arms and operable to exert an apply force to said apply jaws, tool means connected to said force apply jaws of each said pairs of lever arms; each of said tool means having at least one fillet roller for working the material of said fillets of said workpiece as said workpiece is rotatably driven about said central axis and said force generating means is operated to effect the application of a work load to said fillets through said fillet rollers of each said tool means, and bearing structure operatively interposed between said tool means to maintain the orientation thereof and to receive and cancel side loads generated from application of said work load to said fillets.

6. The machine of claim 5, wherein said cylindrical journals are defined by arcuately offset crank pins of a crankshaft for an internal combustion engine and wherein said fillets have centers that are arcuately offset from one another and are radially spaced from the rotational axis of said crankshaft.

7. The machine defined in claim 5 and further comprising base means for said machine and support means extending upwardly from said base means, and swing arm means pivotally secured to said support means and pivot means connections each pair of said lever arms pivotally connected to one another so that said pairs of arms can float as said work piece is pivoted around said rotational axis.

8. A method of simultaneously roll working interfacing fillets of adjacent and contiguous annular crank pins of a crankshaft which are arcuately offset from one another comprising the steps of:

loading said crankshaft into a fillet rolling machine having first and second pairs of jaws and with each pair being movable with respect to one another, each of said pairs of jaws having tools with at least one fillet rolling wheel operatively mounted thereon, placing a fillet rolling wheel associated with a first pair of jaws on the fillet of a first of said adjacent and contiguous crank pins, placing a fillet rolling wheel associated with a second pairs of jaws on the fillet of a second of said adjacent and contiguous crank pins, imparting a rolling load to said rolling wheel of each said pairs of jaws, and turning said crankshaft relative to said rolling wheels so that said rolling wheels contact and simultaneously roll said adjacent and contiguous fillets.

9. A method of simultaneously deep rolling laterally spaced and facing fillets of pairs of contiguous crank pins of a metallic crankshaft for an internal combustion engine located in a side-by-side and a radially offset position with respect to one another comprising the steps of:

a. mounting the crankshaft in a machine with one end in head stock and the other end in the tail stock of the machine, b. positioning a pair of discrete fillet rolling tools each having a fillet roller on said laterally spaced fillets of contiguous said crank pin, and subsequently exerting a pressure on said fillets sufficient to hold the tools is a start position, c. rotatably driving said crankshaft by said machine and applying rolling pressure of at least a predetermined level to said fillets to simultaneously roll said fillets, d. continuing the rolling of said fillets to establish compressive loads in the fillet radius to work the fillet metal to effect the increase the fatigue strength of the crankshaft, e. canceling side loads developed during the rolling of said fillets at a side interface between said tools.

10. A method of deep rolling laterally spaced and facing fillets of pairs of contiguous crank pins of a crankshaft for an internal combustion engine located in a side-by-side and arcuately offset positions with respect to one another comprising the steps of:

a. mounting the crankshaft in a machine with the nose end in the head stock and the flange end mounted on crank center in the tail stock of the machine, b. positioning work roller housings of the machine in a side-by-side relationship adjacent to said laterally spaced and facing fillets, c. operatively engaging one of the spaced and facing fillets with a first fillet roller in a first of said housings and another of the spaced and facing fillets with a second fillet roller in a second of said housings, d. positioning a floating tool on said fillets of said crank pin with outwardly angulated rollers thereon exerting a pressure on said fillets sufficient to hold the tooling is a start position, e. supplying lubricant to said crankshaft and the fillets thereon, f. rotating said crankshaft by said machine and gradually increasing the rolling pressure to a predetermined level so as not to indent the fillets being rolled, g. continuing the rolling of said fillets to establish compressive loads in the fillet radius to resultantly work the metal of said fillets and thereby improve the fatigue strength of the crankshaft,

11. A rolling tool for simultaneously rolling adjacent annular fillets of a pair of contiguous cylindrical journals arcuately offset from one another comprising first and second housings, each of said housings having a cage at the lower end thereof, a hardened work roller operatively mounted in said cage so as to simultaneously roll and fatigue strengthen said adjacent fillets, bearing structure operatively connected between said housings allowing said housings to move in substantially parallel planes and relative to one another and to receive opposing side loads resulting from the simultaneously rolling of said fillets.

* * * * *